US007240631B1

(12) United States Patent
Al-Babtain

(10) Patent No.: US 7,240,631 B1
(45) Date of Patent: Jul. 10, 2007

(54) LOOP BALLAST EXCHANGE SYSTEM FOR MARINE VESSELS

(75) Inventor: Ahmed A. Al-Babtain, Sharjah (AE)

(73) Assignee: Saudi Arabian Oil Company, Dhahran (SA)

( * ) Notice: Subject to any disclaimer, the term of this patent is extended or adjusted under 35 U.S.C. 154(b) by 22 days.

(21) Appl. No.: 11/357,709

(22) Filed: Feb. 17, 2006

(51) Int. Cl.
*B63B 39/03* (2006.01)

(52) U.S. Cl. ..... 114/125

(58) Field of Classification Search ..... 114/125
See application file for complete search history.

(56) References Cited

U.S. PATENT DOCUMENTS 6,053,121 A 4/2000 Tamashima et al.
6,766,754 B1 7/2004 Scott
2002/0174814 A1* 11/2002 Hunter ..... 114/74 R
2004/0139899 A1* 7/2004 Scott ..... 114/125

* cited by examiner

*Primary Examiner*—Stephen Avila
(74) *Attorney, Agent, or Firm*—Abelman, Frayne & Schwab

(57) ABSTRACT

A method and apparatus for replacing existing ballast water in a ballast tank of a ship while the ship is underway in the sea includes a seawater inlet port associated with the ballast tank in the sidewall of the ship's hull and admits water into the ballast tank when the ship is moving by producing a pressure that is greater than the pressure of the ballast water that is to be replaced. The incoming seawater from the inlet port is directed into the ballast tank, and an ejector located on a lower portion of the ballast tank discharges the existing ballast water via an outlet port coupled to the ejector that is located aft of the inlet on the side of the ship's hull.

20 Claims, 4 Drawing Sheets

LOOP BALLAST EXCHANGE SYSTEM FOR MARINE VESSELS

FIELD OF THE INVENTION

This invention relates to methods and apparatus for controlling the intake, exchange and discharge of seawater ballast from marine vessels such as very large crude carriers, container ships, oil tank ships and the like.

BACKGROUND OF THE INVENTION

In order to maintain the stability and safe operation of an empty or partially loaded marine cargo vessel, it is necessary to add seawater to the ballast tanks to trim the vessel and/or to attain a predetermined draft.

In many instances, cargo vessels take on seawater as ballast in a first port, transport the seawater as ballast many thousands of miles to a second port, where cargo is loaded and the seawater ballast discharged into the local harbor or mooring site. It has been well documented that seawater ballast loaded at one location can contain a variety of living organisms ranging from microscopic bacteria to marine plants, fish, crustaceans and other marine life that can have a negative ecological impact when discharged into the local waters at the port of call. Although some efforts have been undertaken to reduce this problem by providing at least a crude filtration system to prevent the intake of rodents, fish, crabs and the like, these efforts have not been particularly effective.

Large volumes of water must typically be introduced into the vessel's ballast tanks and the loading must be done as quickly as possibly due to the large demurrage fees associated with the inefficient loading or idling of commercial marine vessels. Improved methods and apparatus are needed to eliminate or substantially reduce the adverse effects associated with current marine shipping practices that transport and discharge at remote locations large volumes of water that can contain biological and marine life that can have an adverse impact on the marine ecology at the point or points of discharge.

A method and apparatus that includes a bow intake conduit and that utilizes the difference in hydrodynamic pressure for effecting an exchange of water in ballast tanks while the ship is underway is disclosed in U.S. Pat. No. 6,053,121. Pressurized fresh seawater from a main conduit is introduced at the bottom of one end of a ballast tank, and a bottom drain having a valve at the opposite end of the ballast tank discharges the water through the underside of the hull into the sea. As disclosed in the '121 patent, based upon laboratory experimental data, after six hours of operation of a small-scale system, a salt water solution in the primary tank was diluted to 25% of its original salt content. There is no suggestion or teaching in the disclosure of the '121 patent that water in the ballast tank should be discharged through a port or outlet at the top of the ballast tank, nor does it disclose the desirability of the removal of biological marine life from the ballast tank.

An oxygen stripping system, such as the VENTURI OXYGEN STRIPPING SYSTEM® by NEI Treatment Systems, LLC attempts to eliminate the introduction of invasive (i.e., harmful) organisms while simultaneously protecting the vessel's ballast tanks against corrosion. This oxygen stripping system mixes very low-oxygen inert gas into ballast water as it moves through the ballast system, whereby the ballast tanks change to a deoxygenated state. Although this technique is useful in destroying harmful aquatic organisms by suffocation, this technique can causes other environmental problems by also destroying non-harmful organisms that get trapped in the ballast tanks, which is not environmentally friendly.

In commonly assigned U.S. Pat. No. 6,766,754, a ballast water inlet port is provided in the bow of a vessel, where a scoop guides the ballast water through a valve and into the tanks. The water is admitted into the scoop when the vessel is moving under a hydrodynamic pressure that is greater than the pressure of the ballast water that is to be replaced. The incoming seawater from the inlet port is directed into the bottom of the ballast tanks, where it rises to displace the existing ballast water from outlet ports located at a top portion of the ballast tanks from which it is discharged through the hull and down the side of the vessel. Although this technique is much more environmentally friendly, it utilizes a single scoop formed in the bow, which may cause drag, as well as require a substantial amount of piping that extends almost the length of the vessel to fill the ballast tanks.

It is therefore an object of this invention to provide a method and apparatus for rapidly exchanging seawater ballast from marine vessels that eliminates or greatly reduces the transport of the original ballast over great distances from the origin of the ballast, along with the marine organisms contained therein.

It is a further object of this invention to provide an efficient and economical apparatus and method for introducing fresh seawater ballast into the ballast tanks of a marine vessel while the vessel is underway and discharging ballast previously introduced and in an environmental friendly manner.

Yet another object of the present invention is to provide a method and apparatus that permits the ready control of the volume of seawater ballast, as well as its position in any one or more ballast tanks in the vessel, while minimizing the utilization of pumps and power that must be provided while the vessel is underway.

It is yet another object of the present invention to provide a method and apparatus that utilizes minimal moving parts and reduces maintenance requirements and associated costs.

SUMMARY OF THE INVENTION

The above objects and other advantages are achieved through the apparatus and method of the invention in which water is continuously admitted into each ballast tank independently through at least one opening in the side hull of a ship and transmitted through a main conduit communicating with the opening for distribution into the ballast tank to displace existing ballast water in the tank and discharging the ballast water into the sea through one or more outlet ports positioned on the side of the ship that are independently associated with the ballast tank.

As the ship moves through the sea, the seawater is admitted through one or more inlet ports associated with a selected ballast tank and is distributed into the upper region of the ballast tank. An ejector is positioned at the bottom of each ballast tank to remove the existing water from the ballast tank via the outlet ports. The greater the ship's forward speed, the greater will be the volumetric flow of water through the main conduit(s) and thereafter through the ballast tank and the discharge port or ports associated with each tank.

In one embodiment, a loop ballast exchange apparatus is provided for dynamically exchanging ballast water in each ballast tank of a ship while the ship is moving through the sea. Each loop ballast exchange apparatus includes a submerged seawater inlet port located in the side of the ship proximate to, and in fluid communication with the ballast tank. At least one main conduit is in fluid communication with the inlet port and disposed within the ballast tank. At least one tank filling line is coupled to the main conduit and extends in an upward direction. An ejector having an inlet is coupled to the main conduit and disposed within the ballast tank. An outlet port is located on the side of the ship and proximate to the ballast tank, and is in fluid communication with an output of the ejector. Accordingly, fresh seawater admitted through the inlet port flows into the ballast tanks, and the existing water in the ballast tanks is discharged by the ejector through the respective outlet ports positioned on the side of the ship.

In a preferred embodiment, the inlet port is positioned along the side of the ship at a height above the outlet port. The inlet port is in communication with a portion of conduit that initially enters the ballast tank at an angle that is downwardly sloping towards the aft end of the ship. The filling lines extend upward towards the upper portion of the tank. The ejector is positioned proximate the bottom of the ballast tank between the inlet and outlet ports, and the piping coupled between the ejector and outlet port is angled towards the aft of the ship. In this manner, the flow rate of the water through the loop ballast exchange system is improved, and the existing water from the bottom of the tank is removed as the fresh incoming water is being introduced.

In a preferred method of the invention for replacing ballast water in a ballast tank of a ship when the ship is underway in the sea, the method includes the steps of providing seawater to at least one ballast tank through at least one inlet port located on a side of the ship associated with the ballast tank, while the ship is moving through the sea at a pressure that is greater than the pressure of the ballast water that is to be replaced. The pressurized seawater is directed from the at least one inlet port into the ballast tank. The existing water is extracted from the ballast tank and discharged into the sea through at least one outlet port located on the side of the ship toward the aft portion of the ballast tank.

BRIEF DESCRIPTION OF THE DRAWINGS

The invention will be described below in further detail and with reference to the attached drawing sheets in which like elements are referred to by the same number, and where.

DETAILED DESCRIPTION OF THE INVENTION

Figure 1A:
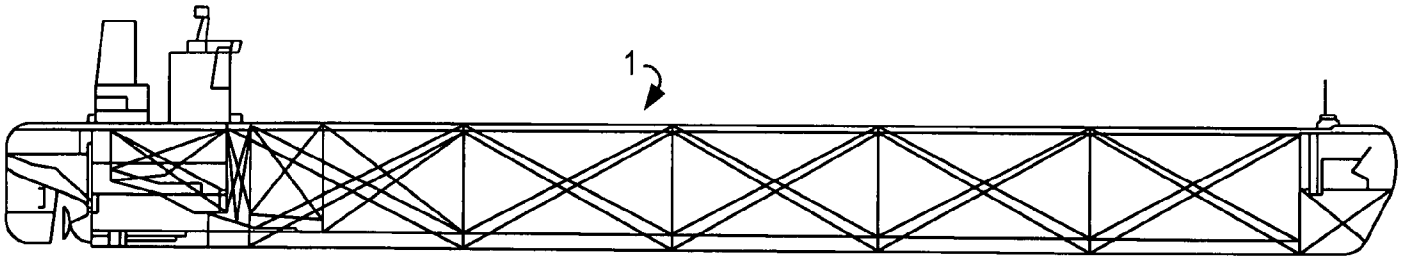
FIG. 1A PRIOR ART
FIG. 1A is a side elevation view of a marine crude carrying vessel of the prior art illustrating a typical construction.
Figure 1B:
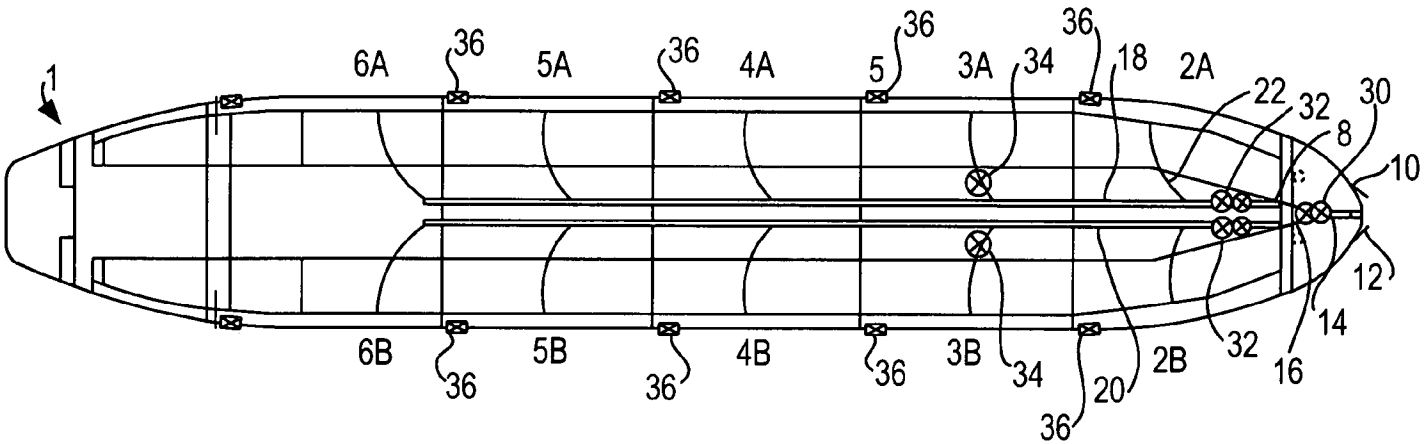
FIG. 1B PRIOR ART
FIG. 1B is a top plan view of a prior art marine vessel similar to that of FIG. 1A equipped with a ballast water inlet valve formed in the bow of the vessel.

Referring to the drawings, FIG. 1A is a side elevation of a typical cargo vessel of the prior art, the forward and central portions providing the cargo holds, with the engine, pump room and other mechanicals in the aft portion of the hull. FIG. 1B is a top plan view of a prior art marine vessel, for example, a typical crude oil tanker 1 having a plurality of port and starboard ballast tanks 2A, 2B, respectively, through 6A, 6B. In accordance with standard marine construction, the tanker has a centerline bulkhead 8 extending from the bow 10 towards the stern. The positioning of the bow and aft superstructure and engine room of a typical vessel of the prior art is shown in the side elevation view of FIG. 1A.

Referring to FIG. 1B, the vessel's bow is fitted with one or more hydraulically operated doors 12 which, when open, permit water to flow into at least one intake conduit 14. In a preferred embodiment, seawater intake 14 is split at a Y-fitting 16 into port and starboard conduit mains 18 and 20, respectively, which extend down either side of centerline bulkhead 8 to provide fresh seawater for ballast exchange to each of the port and starboard ballast tanks.

Each of the port and starboard ballast tanks are joined to a respective port or starboard main conduit 18, 20 by at least one branch line T-fitting, referred to generally as 22. The feedlines 22 are joined to the main conduits 18, 20 by takeoff fittings that will minimize frictional losses as the water changes direction from its longitudinal path along the keel line to a generally transverse flow to be delivered to the individual ballast tanks positioned along the hull. In a preferred embodiment, the transverse feedlines 22 terminate in a bellmouth having a plurality of outlets that are positioned to direct the incoming exchange seawater to reach the entire bottom area or volume of the ballast tank in order to mix with the existing stored ballast and dislodge and keep in circulation any marine life so that it will be flushed from the top of the tank as the exchange is completed. The bellmouth can take the form of a plurality of branched pipes that enter the bottom of the respective ballast tanks through separate fittings. Alternatively, the manifold can take the form of a pipe having only one point of entry through the tank wall that is provided with a plurality of outlets that is secured to the bottom interior wall of the ballast tank.

Each ballast tank along the hull is provided with at least one discharge overflow outlet or port 36 proximate the top of the exterior wall. This discharge port 36 communicates through an opening in the exterior hull of the ship, thereby allowing the ballast water to be discharged into the sea. The hull can be provided with an appropriate fitting to direct the water outwardly away from the side of the ship to minimize the amount of ballast water that will run down the exterior painted hull. Conduits carrying pressurized sea water with appropriately valved fittings can also be provided in the vicinity of the ballast discharge overflow ports to wash the exterior surface of the hull to remove any dirt, marine life or the like that may have accumulated on the hull as a result of the discharge of stagnant ballast water.

In order to control the flow of incoming seawater during the ballast exchange process and to maintain the ballast in the tanks at the end of the process, primary and secondary backup valves are provided in accordance with current marine safety standards and regulations. Intake conduit 14 at the bow of the ship is provided with a pair of gate or globe valves 30, and each of the port and starboard main conduits 18 and 20 are each provided with a set of two butterfly segregation valves 34 for each of the tank feeder lines 22. The discharge or overflow ports for each of the ballast tanks are preferably provided with a pair of butterfly valves 36. The back-up valves for the discharge ports should be positioned as close to the deck of the ship as possible.

In the method of operation of the invention, the bow door(s) 12 are opened and the hydraulic pressure in the upstream end of conduit 14 is measured and noted using appropriate instrumentation while the ship is underway. Once the hydrodynamic pressure has achieved the predetermined minimum to initiate ballast exchange, overflow valves 36 are fully opened and one or more of valve sets 34 are opened to admit water to port and/or starboard main conduits 18 and 20. Ballast exchange in one or more of the port and/or starboard ballast tanks is commenced by opening valves 22 in a predetermined sequence. For example, before the ship reaches its maximum relative velocity with respect to the sea through which it is moving, the relative hydrodynamic or hydraulic pressure differential may not be sufficient to permit the overflow of all of the ballast tanks. Using information derived from pressure gauges on the main conduits 18 and 20 and on each of the transfer feedlines 22, fresh seawater is admitted to one or more tanks to begin ballast exchange. The volumetric flow rate through transfer lines 22 is monitored using conventional instrumentation until the predetermined desired amount of fresh seawater has been passed into and through the respective ballast tanks.

Utilizing an appropriately programmed general purpose computer, the data relating to differential pressures and flow rates at relevant positions on each of the main conduits and individual ballast tank feed lines is collected and entered to provide the operator with information relating to the rate of exchange of ballast water, time required to completion and a completion signal. Automatic valve controllers are also programmed to respond to pressure and flow rate data points so that when one or more ballast tank exchanges have been completed, feed valves 34 are closed and ballast tank overflow valves 36 are closed when the system has stabilized. Although the prior art apparatus and method illustrated in FIGS. 1A and 1B provides an effective technique for exchanging ballast and removing life forms from the tanks in an environmentally friendly manner, the loop ballast exchange system of the present invention as described in more detail below, eliminates the need for installation of doors and a mechanism for opening and closing these doors in the bow, as well as the installation of the main conduits along the centerline bulkhead 8 for substantially the length of the vessel.

Figure 2:
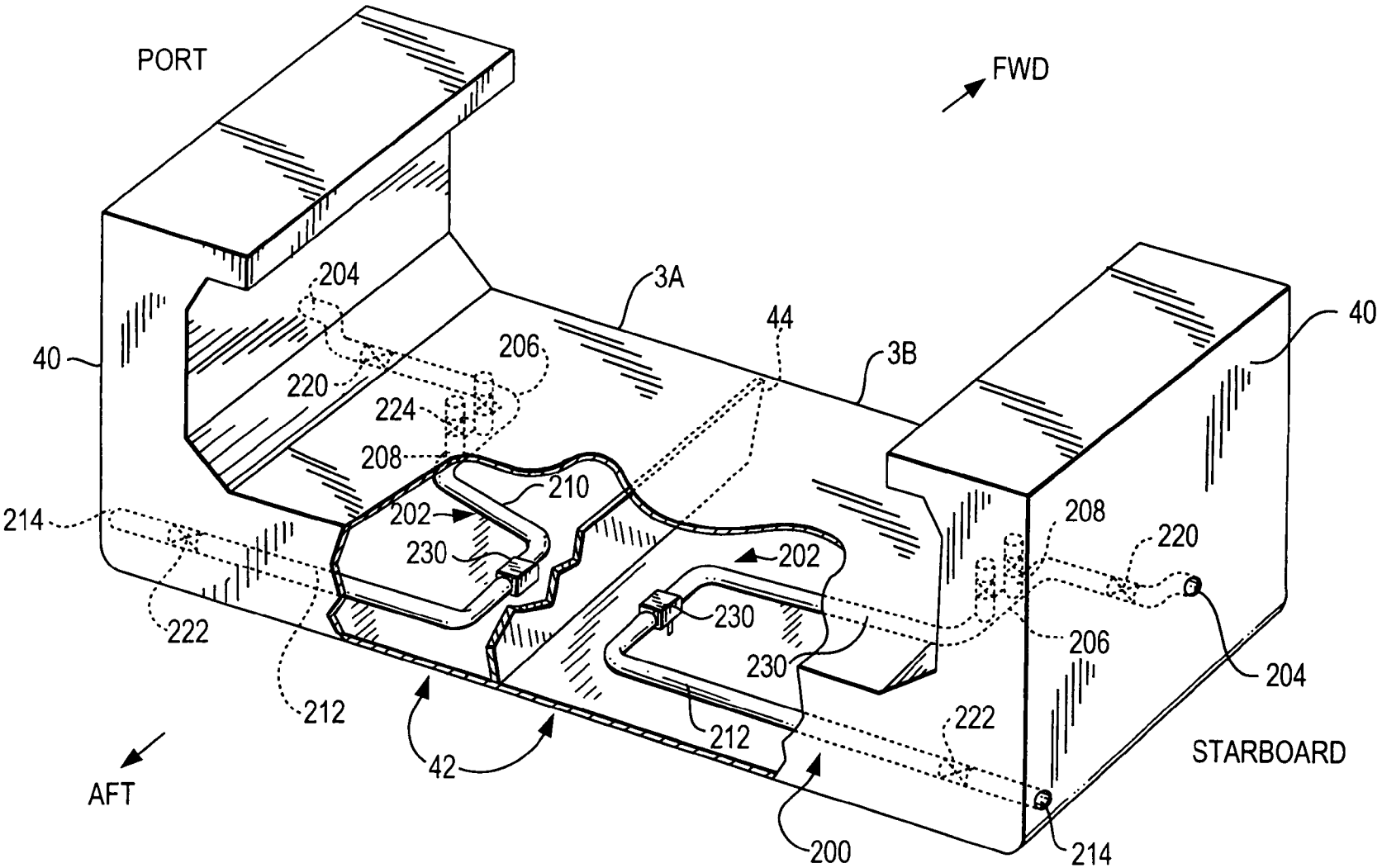
FIG. 2 is a simplified side perspective schematic view of an opposing pair of typical port and starboard ballast tanks showing the installation of one embodiment of the loop ballast exchange system of the present invention.

Referring to FIG. 2, a loop ballast exchange system 200 of the present invention is provided in each ballast tank of a marine vessel 1. For illustrative purposes, a pair of loop ballast exchange systems 200 is illustratively shown as being provided in opposing (i.e., port and starboard) double hull ballast tanks 3A and 3B of a marine vessel 1. One skilled in the art will appreciate that a separate and independently controlled loop ballast exchange system is provided in each of the ballast tanks 2A-6B of FIG. 1B, in place of installing the main conduits 18 and 20 and feedlines 22. Each loop ballast exchange system 200 controls the amount of seawater admitted, retained, and discharged in its associated ballast tank while the marine vessel is underway. Although the loop ballast exchange system 200 is illustratively shown and described with respect to double hull tankers, the present invention is also suitable for use in single hull tankers, and is in compliance with the International Maritime Organization regulations.

Each loop ballast exchange system 200 comprises a water inlet port 204, an inlet valve 220, a first pipe section 206, at least one tank filling line 208, at least one non-return (check) valve 224, a second pipe section 210, an ejector 230, a third pipe section 212, an outlet valve 222, and a water outlet port 212. The first pipe section 206, second pipe section 210 and third pipe section 212 collectively form a main conduit 202 of the loop ballast exchange system 200. Each of the loop ballast exchange systems 200 exchanges seawater in the ballast tank from the side 40 of the hull, as opposed to an opening (door) or inlet port formed in the bow of the vessel.

The water inlet 204 is formed in the side 40 of the hull below the surface of the seawater, and extends through the illustrative double walls of the hull and into the illustrative ballast tank 3B. The water inlet 204 is defined by a pipe having an orifice formed in the outer wall of the hull. In one embodiment, the inlet 204 extends downward and is angled in a direction towards the aft end of the vessel, to a first end of the inlet valve 220, which controls the entry of seawater into the loop ballast exchange system 200. The first pipe section 206 is coupled to the downstream side of inlet valve 220, and in one embodiment, continues to extend downward and at an angle in a direction towards the aft portion of the vessel, until the first pipe section 206 is proximate the bottom 42 of the ballast tank 3B.

Figure 3:
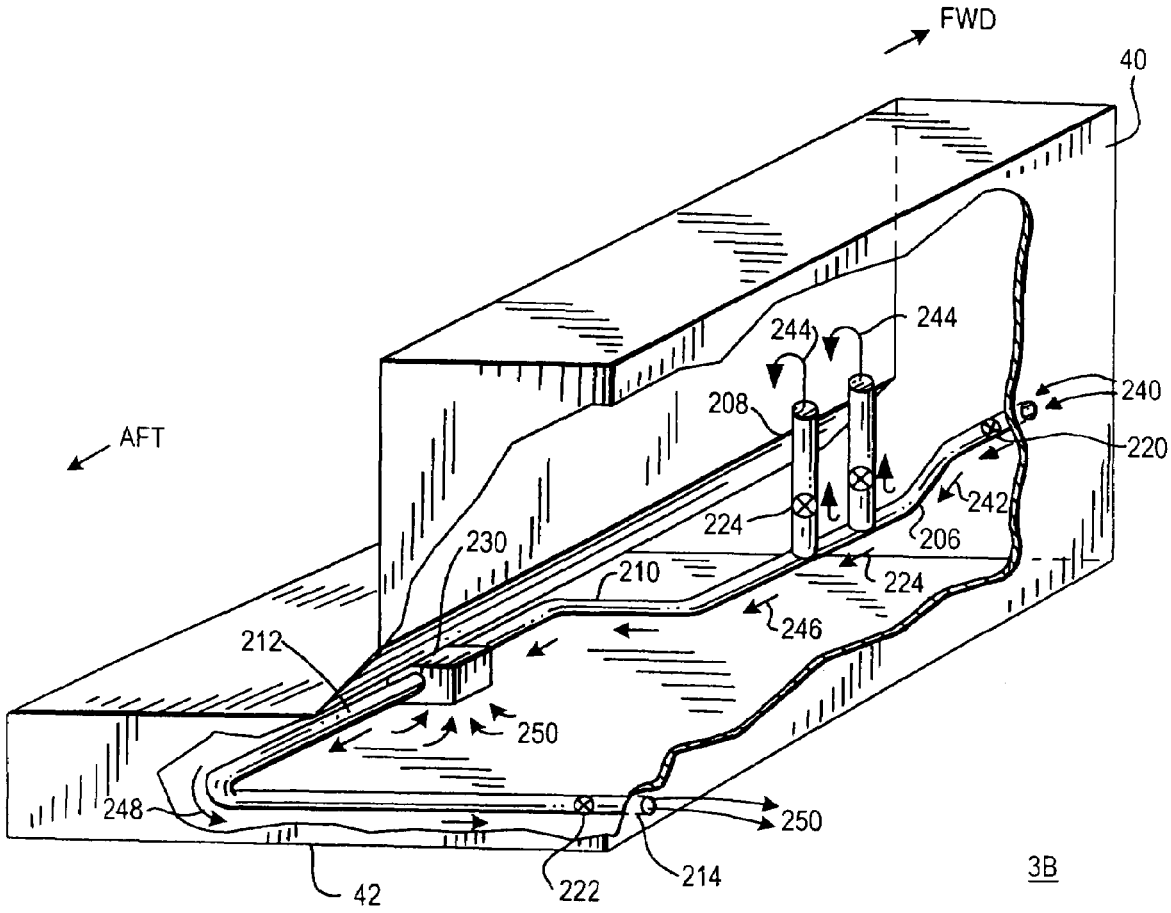
FIG. 3 is an enlarged schematic side elevation view of the loop ballast exchange system of FIG. 2 illustrating the exchange of water in the ballast tank.
Figure 4:
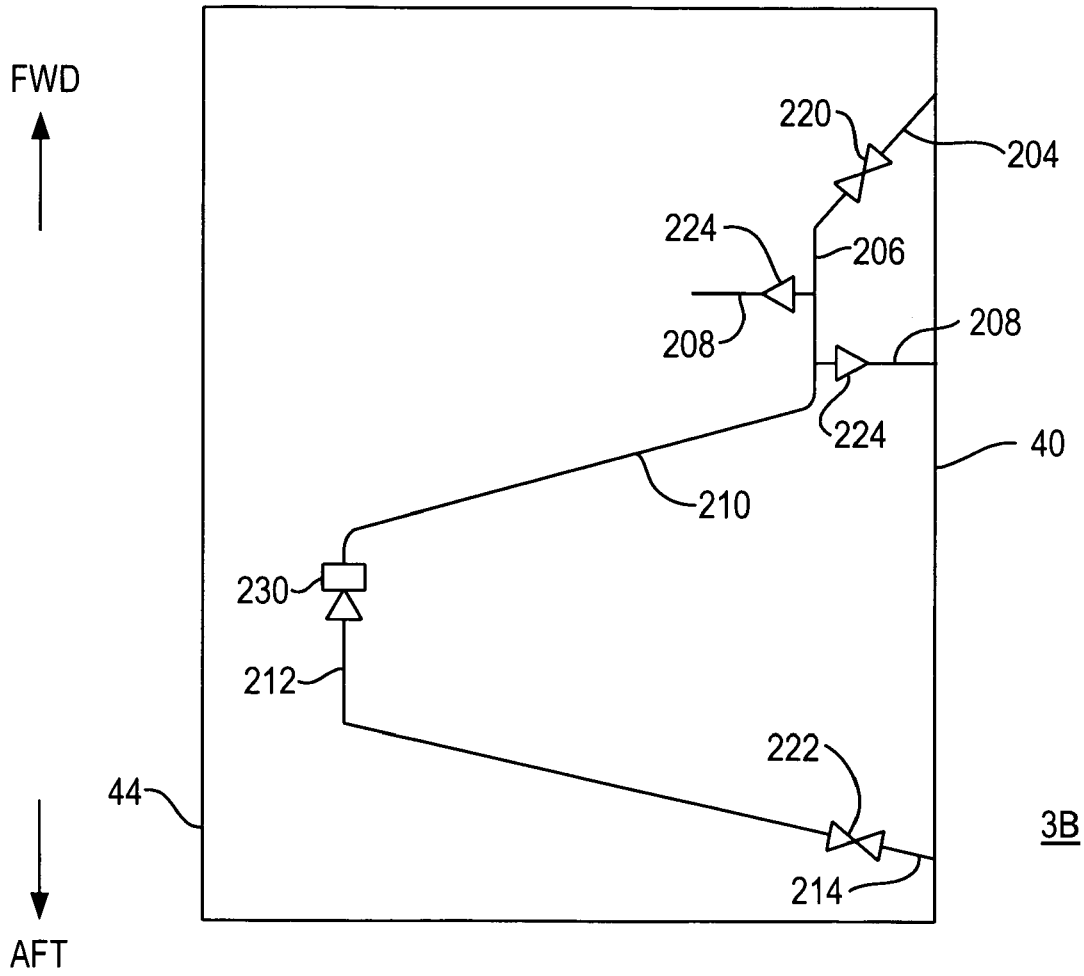
FIG. 4 is a schematic plan view of the embodiment of the loop ballast exchange system of FIG. 2.

Referring to FIGS. 3 and 4, once the downstream end of pipe 206 is proximate the bottom 42 of the ballast tank 3B, the first pipe section 206 is preferably routed in the direction towards the aft, substantially horizontally or parallel to the bottom 42 of the tank and parallel with the side 40. The first pipe section 206 is coupled to the second pipe section 210 which, in one embodiment, traverses inward at an obtuse angle towards the vessel's centerline bulkhead 44. The second pipe section 210 is coupled to a first end (i.e., input) of the ejector (e.g., eductor) 230 proximate the centerline 44.

The second end (i.e., output) of the ejector 230 is coupled to the third pipe section 212. The third pipe section 212 extends a first length substantially parallel to the centerline bulkhead 44 towards the aft, and then turns outward for a second length at an obtuse angle back towards the side 40 of the hull. The third pipe section 212 is coupled to the outlet valve 222 proximate the side 40 of the hull. The outlet valve 222 is coupled to the water outlet 214, which is formed in the outer surface 40 of the hull.

In a preferred embodiment, each inlet port 204 and first pipe section 206 is angled from the side 40 of the ship in a direction from forward to aft. Optimally, the inlet port 204 and first pipe section 206 can be angled in a range of approximately 15 to 25 degrees, and preferably 20 degrees. In this manner, as the ship proceeds in a forward direction, the water enters the inlet ports 204 on the port and starboard sides 40 of the ship, and flows aft through each main conduit 202. By angling the inlet ports 204 and first pipe sections 206 inwardly towards the center of the vessel, the flow of water is increased. Similarly, angling the third pipe sections 212 and outlet ports 214 outwardly and towards the aft position of the vessel helps increase the discharge of the exchanged water from the tanks. Optimally, the third pipe section 212 and outlet port 214 can be angled in a range of approximately 65 to 75 degrees, and preferably 70 degrees.

Although the main conduit 202 is shown and described as being near the bottom surface 42 of the tank proximate the centerline bulkhead 44 of the vessel, such layouts (i.e., routing patterns) should not be considered as being limiting, and one skilled in the art will appreciate that other routing paths for the main conduit 202 are also possible. For example, the main conduit 202 can be routed proximate the side 40 of the ballast tank, such that the ejector 230 is positioned proximate the outlet valve 222.

Referring to FIGS. 2 and 3, one or more (e.g., a pair of) tank filling lines 208 is coupled to the first pipe section 206. In one embodiment, the tank filling lines 208 extend a distance vertically and discharge above the height of the water inlet 204. Each tank filling line 208 includes a check valve 224, which prevents the water from flowing back into the first pipe section 206. Furthermore, the check valves 224 are set to close under a pressure associated with a maximum water height in the tank. In one embodiment, the check valves 224 are set to close at a pressure associated with a water height being approximately 90%-95% of the maximum water height in the tank. That is, when the ballast tank is filled with water approximately 90-95%, the check valve 224 closes. At this time, any additional water entering the main conduit 202 via the inlet port 204 simply flows through the conduit 202 and out the outlet port 214. Although the tank filling lines 208 are shown as extending vertically upward from the first pipe section 206, one skilled in the art will understand that the tank filling lines 208 can be angled in an upward direction.

For example, the one or more of filling lines 208 can be angled in a direction towards a side of the ship, towards the centerline bulkhead 44, forward or aft, or any combination thereof to disperse the water into the tank. In this alternative embodiment, the check valves are still used to prevent backflow of water into the main conduit 202, as well as close the filling lines when a particular height of water in the tank is reached.

The present invention preferably utilizes and eductor type ejector 230 to remove ballast water from the ballast tanks. The ejector 230 is preferably positioned proximate the bottom 42 of the tank to remove the existing water as the incoming fresh sea water rises towards the upper portion of the tank.

An eductor 230 is an ejector device that uses a high pressure motive fluid to create a low pressure zone and remove a lower pressure surrounding fluid (i.e., the existing seawater in the tank). An eductor differs from a conventional pump since the eductor has no moving parts, and is advantageous because it helps reduce maintenance requirements and related costs. The eductor 230 may be any commercially available eductor fabricated from non-corrosive materials, such as PVC, polypropylene, or other plastics, Monel, among other well-known non-corrosive materials.

Preferably, the flow rate of the motive fluid into the eductors 230 is one cubic meter per second (1 $m^3$/sec), although such flow rate is not limiting. In one embodiment, the high pressure motive fluid source for activating each eductors 230 is provided by the water flowing through the corresponding input port 204, first pipe 206 and second pipe 210. As discussed in greater detail below, in one embodiment, when an eductor 230 is activated, the check valves 224 in the filling lines 208 are closed, thereby forcing the flow of water through the eductor 230. Alternatively, the high pressure motive water sources can be provided by a water pump (not shown). Although the present invention is discussed in terms of being implemented with an eductor 230, one skilled in the art will appreciate that other fluid removing devices can be utilized, such as an extractor, jet pump, ballast pump or other commercially available device capable of discharging liquid (i.e., seawater) from one environment and routing it to another environment.

The stop valves 220 and 222 discussed herein as part of the present invention are preferably butterfly valves. However, one skilled in the art will appreciate that the stop valve can alternatively be a globe valve, a gate valve, a ball valve, or any other stop valve, including a stop-check valve. Similarly, the check valves 224 discussed herein as part of the present invention are preferably ball type check valves. However, one skilled in the art will appreciate that the check valve can be a butterfly type valve, a swing type valve, a lift type valve, or a stop-check valve.

Although not shown in the figures, redundant valves can be provided as desired along each loop ballast exchange system to comply with International Marine Organization Ballast Water Management regulations. For example, each inlet port 204 and outlet port 214 can be provided with two sequential stop valves that are controlled by hydraulically-operated actuators. The use of two valves in series provides an added margin of safety in the event of a malfunction or blockage in one of the valves. The operation of the hydraulic actuators is preferably directed from a control panel located in the cargo control room, bridge and/or another operations area of the ship. As a further safety precaution, manually operable valve positioners can also be provided for each valve.

Referring to FIG. 3, in a method of operation, when the intake stop valve 220 is closed, the seawater is blocked from flowing into the main conduit 202 and ballast tank. When the stop valves 220 are open, and as the vessel moves forward, seawater 240 will flow into the angled inlet port 204. The incoming seawater flows through the first pipe section 206 along the path represented by arrow 242. When the check valves 224 of the filling lines 208 are open, at least a portion, if not all, of the incoming water flows up through the filling lines 208 and into the ballast tank 3B, as illustratively shown by arrows 244. Depending on the speed of the vessel, not all of the incoming water along path 242 will flow into the ballast tank 3B via the filling lines 208. Rather, a portion of the incoming water may continue to flow into the second pipe section 210 towards the eductor 230, along the path shown by arrow 246. The fresh water that does not flow into the tank by the filling lines 208 will eventually flow through the third pipe section 212 and out the side of the vessel via the outlet port 214.

As shown in the preferred embodiment of FIGS. 2 and 3, the inlet port 204 is positioned in the sides 40 of the vessel 1 at a height above the outlet port 214. Positioning the inlet port 204 above the outlet port 214 is advantageous because it allows hydraulic pressure to assist in forcing the fresh sea water through the main conduit 202, as well as increase the flow rate due to the height differential between the inlet and outlet ports. Additionally, since the ejector 230 is positioned proximate the bottom 42 of the tank 3B, in one embodiment, the outlet port 214 is positioned approximately at the same level or below the height of the ejector 230, to reduce the force required by the ejector 230 to remove the water from the ballast tank. One skilled in the art will appreciate that the heights of the inlet ports 204 and outlet ports 214 can also be at approximately the same height along the sides 40 of the vessel 1.

Referring to FIG. 4, the incoming seawater 240 flows at an angle directed from the forward section towards the aft section of the ship. By angling the intake port and first pipe section 206 of the main conduit 202, the incoming seawater 240 has minimal resistance entering the inlet port 204 and the hydrodynamic forces created by the movement of the vessel in the sea enables the seawater 240 to flow through the main conduit 102 and the filling lines 208. Similarly, the discharged seawater 250 is also expelled at an angle to the flow of water along the hull towards the aft section of the ship. By angling the third pipe section 212 and outlet port 214, the resistance to the flow of discharged water is decreased.

Referring to FIG. 3, once the ballast tank 3B is filled to a desired level (e.g., based on cargo storage conditions), the present invention provides for an environmentally friendly exchange of seawater in the ballast tanks. As the ship is propelled through the sea, the stop valves 220 and 222, as well as the check valves 224 are opened and the seawater 240 is allowed to flow through the main conduit 202 and filling lines 208.

Seawater is exchanged in the tank by activating the eductor 230 to remove water from the bottom of the tank as the ship is propelled across the sea. When an eductor 230 is activated, the check-valves 224 are closed, thereby allowing water from the bottom of the ballast tank to be extracted into the main conduit 102, and more specifically, into the third pipe section 112 for expulsion from the tank via the outlet port 214 provided on the side of the vessel. Once a predetermined amount of seawater has been removed from the tanks, the eductor 230 is deactivated and the check-valves 224 are opened to permit the seawater to fill the tanks, as described above. Accordingly, a cycling process is performed to fill and then empty the water in the tanks, as the ship is travels to its destination.

As the relative velocity of the ship through the surrounding seas increases the hydrodynamic pressure in the main conduits 102 associated with each ballast tank to a level sufficient to effect exchange in additional ballast tanks, an appropriate number of valves 220 and 222 for the respective tanks to be exchanged are opened. The operator or, optionally, the programmed general purpose computer (not shown), also controls the position of intake valves 222 in the event that the downstream pressure requirements to affect the desired rate of ballast exchange are exceeded. Should the pressure in a main conduit 202 decrease below a predetermined value due to a change in the ship's speed or its velocity relative to the surrounding sea, valve controllers (not shown) automatically respond to close one or more valve sets. For example, if the ship were to be placed in an emergency stopping mode, the inlet valves 220 and outlet valves 222 can be closed in order to maintain the water levels in the ballast tanks. Any necessary reduction in the water levels of the individual tanks can be made by closing the inlet valves 204 to prevent fresh water from entering, and activating ballast pumps to discharge the desired amount of seawater.

As will be apparent to one of ordinary skill in the art, the rate at which the water is changed in the vessel's ballast tanks will depend upon a number of variable factors, including the diameter of the intake ports 204, diameter of the main conduit 202, diameter of the outlet ports 214, speed of the vessel, capacity of the ejectors 230, and the like. The determination of these variables and the necessary calculations required to effectuate the practice of the method and apparatus of the invention in a particular ship and under specific operating conditions are well within the ordinary skill of those working in the art.

In a further preferred embodiment, the flow of incoming seawater to one or more ballast tanks can be reduced or shut-off entirely when the ship is moving at speeds that produce a relatively lower hydrodynamic force at a predetermined hull location or locations. In this mode of operation, incoming water can be directed independently to one or a group of tanks in order to achieve a complete flushing and replacement of water. After the first one or group of tanks have achieved the desired degree of exchange, the flow is decreased and/or entirely shut-off to those tanks in favor of another one or group of tanks. As the ship's speed and the associated hydraulic pressure increases, the exchange rate for individual tanks also increases.

In one preferred embodiment of the practice of the invention, a vessel that is provided with the ballast loading and discharge apparatus of the invention is loaded with the minimum amount of seawater ballast required to trim the vessel and permit its safe movement from a moored or docked location. After the vessel has moved away from its mooring position and gathers speed, one or more inlet ports 204 are open to allow the fresh water to enter the loop ballast exchange system. Associated check valves 224 in the filling lines 206 are opened to permit entry of seawater and the ballast tanks are filled to the predetermined desired level. Once the desired volumes of seawater ballast has been loaded and while the ship is still underway, ballast discharge valves are opened and the ballast in the tanks is discharged in a steady-state or equilibrium flow of input and discharge. In this practice of the method, the ballast water continuously circulates through the loop from an intake port on the side of the vessel through the tanks and is discharged back into the sea also through the side of the vessel. The flow will continue without affecting the vessel and its structure provided the valves are left open at all times. In this way, the invention avoids the current practice of loading and transporting ballast water containing local marine life from one location and discharging it at a port that may be many thousands of miles away.

The method can be continued during the voyage so that exchange is continuous. Alternatively, the original ballast can be maintained during most of the voyage and the exchange started when the vessel is closer to the destination, but still at sea. The exchange will then bring local marine life into the ballast tanks, and any necessary discharge thereof in port will not have an adverse ecological effect.

In the event that speed limitations, ocean currents, height of waterline requirements, piping restrictions due to the ship's pre-existing configuration, and/or other design and operational conditions do not provide sufficient pressure to effect a complete exchange, auxiliary ballast water pumps can be employed in the practice of the invention.

As will be understood from the above description, the invention provides for various modes of operation when the ship is underway. These modes will depend upon the relative speed at any given time, and also on the rate of change of the speed with respect to the sea through which the ship is moving.

The use of conventional instruments that are adapted for use in the method and with the apparatus of the invention will provide a means for visually displaying the condition of each of the ballast tanks and the extent to which the original ballast water has been exchanged with the seawater through which the ship is moving.

As will be apparent to one of ordinary skill in the art, the entire system can optionally be controlled by an appropriately programmed general purpose computer. Using calibration data obtained empirically and/or by theoretical calculations, the times and rates of exchange at various flow rates are determined for a number of different velocities of the ship relative to the water at the intake ports. Flow meters can be installed at different positions along the main conduit to provide accurate data in real time, thereby permitting automatic, programmed adjustments of individual valves, or groups of valves in response to changing conditions.

Programs can include exchange on a first-in, last-out basis, or vice-versa; or on an equal flow and exchange in all ballast tanks simultaneously; or on any ad hoc order selected by the operator at the start of the ship's departure from the unloading facility.

Flow meters can also be installed at the outlet ports to provide information in real time to the control panel to indicate the relative rate of exchange of water in each of the ballast tanks. The hydraulic actuators can be utilized to adjust the flow rate through successive valves until the desired balance is obtained. The rate of flow through the respective ballast tanks can also be controlled by adjusting the ejectors. An appropriately programmed general purpose computer can be utilized to make these corrections automatically.

Additional instrumentation can include temperature sensors located at the inlet ports for the incoming seawater, at the outlet ports, and at one or more positions in the ballast tanks. Since the temperature of the water held in the ballast tanks will be different, i.e., warmer or colder than the incoming seawater, the temperature differential information can also serve to indicate the extent of the exchange. For example, when the temperature of the overflow and incoming seawater are the same, or substantially the same, the exchange will be completed.

From the above, it will be understood that the exchange of ballast is essentially continuous so long as the ship is moving at a sufficient speed to establish the required hydraulic pressure and the inlet ports are admitting fresh seawater through the main conduits. In this way, marine organisms peculiar to one locale will be mixed with seawater as soon as the ship is underway and completely displaced from the ballast system by the flushing action within three volumetric exchanges.

The flow rate of ballast exchange water is dependent upon a number of factors including the speed of the ship relative to the water through which it is moving, the diameter of the main conduit and the diameter of the respective piping through which water is admitted into each of the ballast tanks. In many large tankers, the ballast tanks extend about six feet between the outer hull plates and the inner walls of the tanks. Ample space is thus provided for installation of one or more inlet and outlet valves on each side of the hull. In accordance with conventional design, the ballast tanks are also fitted with air vents.

While the foregoing is directed to embodiments of the present invention, other and further embodiments of the invention may be devised without departing from the basic scope thereof, which is to be determined by the claims that follow.

I claim:

1. A method for replacing ballast water in a ballast tank of a ship when the ship is underway in the sea comprising the steps of:

providing seawater to a ballast tank through at least one inlet port associated with said ballast tank located on a side of the ship when the ship is moving through the sea at a pressure that is greater than the pressure of the ballast water that is to be replaced;

directing the pressurized seawater from the at least one inlet port into the ballast tank;

extracting existing water from the ballast tank; and discharging said extracted water into the sea through at least one outlet port associated with said ballast tank and located on the side of the ship.

2. The method of claim 1, wherein the pressurized sea water is distributed towards an upper portion of the ballast tank via at least one filling conduit.

3. The method of claim 2, further comprising directing the flow of water in a single direction via a check-valve positioned in each said filling lines.

4. The method of claim 3, further comprising closing said check-valve in response to water level in the ballast tank reaching a predetermined height.

5. The method of claim 1, wherein said extracting step comprises removing said existing water from a lower portion of said ballast tank.

6. The method of claim 1 which comprises the further steps of:

measuring the flow rate of the seawater discharged from the at least one outlet port;

continuing the discharge of seawater from the at least one outlet port for a predetermined time that is based on the flow rate;

terminating the flow of water into the ballast tank; and closing the at least one outlet port to seal the tank.

7. The method of claim 6, wherein the discharge is continued for a time that is sufficient to effect a predetermined minimum effective exchange of replacement seawater with ballast water that is to be replaced.

8. The method of claim 7 further comprising:

monitoring the water level in each ballast tank of the ship; and independently regulating seawater inflow into and discharge from each ballast tank on the ship in response to differing water levels between ballast tanks.

9. The method of claim 1, wherein said step of providing seawater through at least one inlet port located on a side of the ship comprises directing the flow of water at an angle towards the aft portion of the ship.

10. The method of claim 1, wherein said discharging of said extracted water into the sea through at least one outlet port comprises directing the flow of water at an angle towards the aft portion of the ship.

11. A loop ballast exchange apparatus for independently dynamically exchanging ballast water in each of a plurality of ballast tanks of a ship while the ship is moving through the sea, each apparatus comprising:

a. a submerged seawater inlet port located in the side wall of the hull of the ship adjacent each ballast tank;

b. a main conduit in fluid communication with the inlet port and disposed within said ballast tank;

c. at least one tank filling line coupled to said main conduit and extending in an upward direction;

d. an ejector having an inlet coupled to said main conduit and disposed in said ballast tank; and e. at least one outlet port located in the side wall of the hull of the ship adjacent each ballast tank, said at least one outlet port coupled to an outlet of said ejector, wherein seawater admitted into the inlet port flows from the side of the ship and into the ballast tanks, and the water in the ballast tanks is discharged by said ejector through the one or more outlet ports positioned on the side of the ship.

12. The apparatus of claim 1 wherein each inlet port comprises a stop valve for controlling inflow of water through the main conduit.

13. The apparatus of claim 11, wherein each outlet port comprises a stop valve for controlling outflow of water from the main conduit.

14. The apparatus of claim 11, wherein each filling line comprises a check valve for controlling outflow of water from the ballast tank.

15. The apparatus of claim 11, wherein each ejector is located in the ballast tank proximate the centerline of the ship.

16. The apparatus of claim 11, wherein said ejector is located at a lower portion of said ballast tank.

17. The apparatus of claim 16, wherein said ejector includes an eductor.

18. The apparatus of claim 11, wherein said at least one inlet port located on a side of the ship is angled to direct the flow of fresh water admitted towards the aft portion of the ship.

19. The method of claim 11, wherein said at least one outlet port is angled to discharge water through the side wall in a direction towards the aft portion of the ship.

20. The apparatus of claim 11, wherein each main conduit extends aft between the at least one inlet port and at least one outlet port.

* * * * *